United States Patent [19]

Shahan

[11] Patent Number: 4,605,379

[45] Date of Patent: Aug. 12, 1986

[54] KINESCOPE PANEL/MASK FRAME ASSEMBLY THUMPER AND FLUSH DEVICE AND METHOD

[75] Inventor: Donald J. Shahan, Lancaster, Pa.

[73] Assignee: RCA Corporation, Princeton, N.J.

[21] Appl. No.: 769,977

[22] Filed: Aug. 27, 1985

[51] Int. Cl.[4] ..... H01J 9/20

[52] U.S. Cl. ..... 445/59; 209/130; 445/60

[58] Field of Search ..... 445/59, 60; 15/141 R; 130/28; 209/127.1, 130

[56] References Cited

U.S. PATENT DOCUMENTS

| | | | |
|---|---|---|---|
| 149,981 | 4/1874 | Booz | 130/28 |
| 425,761 | 8/1890 | Edison | 209/130 |
| 1,307,874 | 6/1919 | Olleo | 15/141 R |
| 3,712,699 | 1/1973 | Syster | 445/59 |

FOREIGN PATENT DOCUMENTS

| | | | |
|---|---|---|---|
| 139462 | 10/1979 | Japan | 445/59 |
| 152858 | 12/1979 | Japan | 445/59 |

*Primary Examiner*—Kenneth J. Ramsey
*Attorney, Agent, or Firm*—E. M. Whitacre; D. H. Irlbeck; L. L. Hallacher

[57] ABSTRACT

An apparatus for removing undesirable particles from a kinescope panel/mask frame assembly includes a plurality of thumper arms. The arms have a cam follower at one end and a thumper at the other end. Cams on a rotatable shaft engage the cam followers to raise the thumpers above the panel. The cams include inset portions to disengage the cams and cam followers. The cams and cam followers face in opposite directions so that the thumpers alternately impact the panel. During the thumping, charged air is passed across the panel/-mask frame assembly to charge the assembly and any particles adhering to the assembly because of static charge. The like charges cause the particles to be repelled from the assembly. The combination of the charged airflushing and thumping disengages particles from the assembly which otherwise could cause blocked apertures or shorted electron guns.

11 Claims, 4 Drawing Figures

KINESCOPE PANEL/MASK FRAME ASSEMBLY THUMPER AND FLUSH DEVICE AND METHOD

BACKGROUND

This invention relates generally to the production of kinescopes and particularly to an apparatus for thumping and airflushing kinescope panel/mask frame assemblies to reduce blocked apertures and electron gun shorts in such kinescopes.

The kinescope or picture tube for color television receivers includes a phosphor screen which is composed of alternating stripes of phosphors, each of which emits a different color of light when impacted by electrons. The phosphor stripes are produced on the faceplate panel by coating the inside surface of the panel with a slurry of one of the phosphors. A thin metal apertured shadow mask, which is supported on a sturdy metal frame, is inserted into the panel. The panel/mask frame assembly is placed upon a movable table of an exposure mechanism, commonly called a lighthouse. The lighthouse includes a bright light source which is used to expose the dried phosphor slurry to light. After the exposure is completed, the assembly is removed from the lighthouse table. The shadow mask is removed and another phosphor slurry is applied to the panel. The shadow mask is reinserted into the panel and the assembly is again placed upon the movable lighthouse table and the second applied phosphor slurry is exposed by the lighthouse. This process is repeated until all the phosphor strips are produced on the panel.

In the operation of a kinescope, an electron beam is provided for each of the three primary colors red, green and blue. The three electron beams converge at the shadow mask and pass through the apertures in the shadow mask so that each beam impacts a phosphor of the proper light emitting color. The shadow mask apertures are quite small and therefore small airborne contaminants, such as glass particles, metal flakes, dust particles, small fibers, etc. can easily block an aperture and cause a dark spot on the kinescope screen during the operation of the tube. Additionally, during the operation of the kinescope the screen and the shadow mask within the panel/frame assembly are scanned by electrons so that any particles which previously adhered to the screen or shadow mask are charged with a negative polarity. The screen and shadow mask are operated at a high positive potential so that the charged particles have a tendency to adhere the shadow mask, thereby greatly increasing the probability of blocked apertures. Also, during the production of the phosphor screen, the shadow mask is frequently inserted into and removed from the faceplate panel. This greatly increases the probability of small metal slivers falling from the shadow mask, the shadow mask support frame, and the springs and studs which retain the shadow mask in the panel. Such metal slivers can result in blocked apertures, or they can fall into the electron gun of a completed kinescope and cause electrical shorts in the electron gun. The phosphors are applied to the panels as slurries which adhere to the glass of the faceplate panel. Accordingly, airborne contaminants and metal slivers can readily adhere to the phosphors and subsequently fall from the screen and cause either a blocked aperture or an electron electron gun short. For these reasons there is a need for an apparatus for removing the maximum number of small particles from the panel/mask frame assemblies of kinescopes prior to the panels being fitted to funnels. The instant invention is directed to such an apparatus.

SUMMARY

A device for dislodging potentially aperture blocking particles from the panel/mask frame assemblies of kinescopes includes a fixed shaft and at least one thumper arm pivotably supported by the said fixed shaft. One end of the arm has a cam follower, and the other end of the arm supports a faceplate thumper. A rotatable shaft is arranged substantially parallel to the fixed shaft. At least one cam is fixed to the rotatable shaft for rotation with the shaft. The cam has a curved surface which engages the cam follower and raises the faceplate thumper above a faceplate panel located in the proximity of the thumper. The cam also has an inset portion for disengaging the cam follower whereby the arm pivots downwardly and the thumper impacts the faceplate panel. As the rotatable shaft is rotated charged air is blown the panel/mask frame assembly while the thumper impacts the top of the panel.

DETAILED DESCRIPTION

Figure 1:
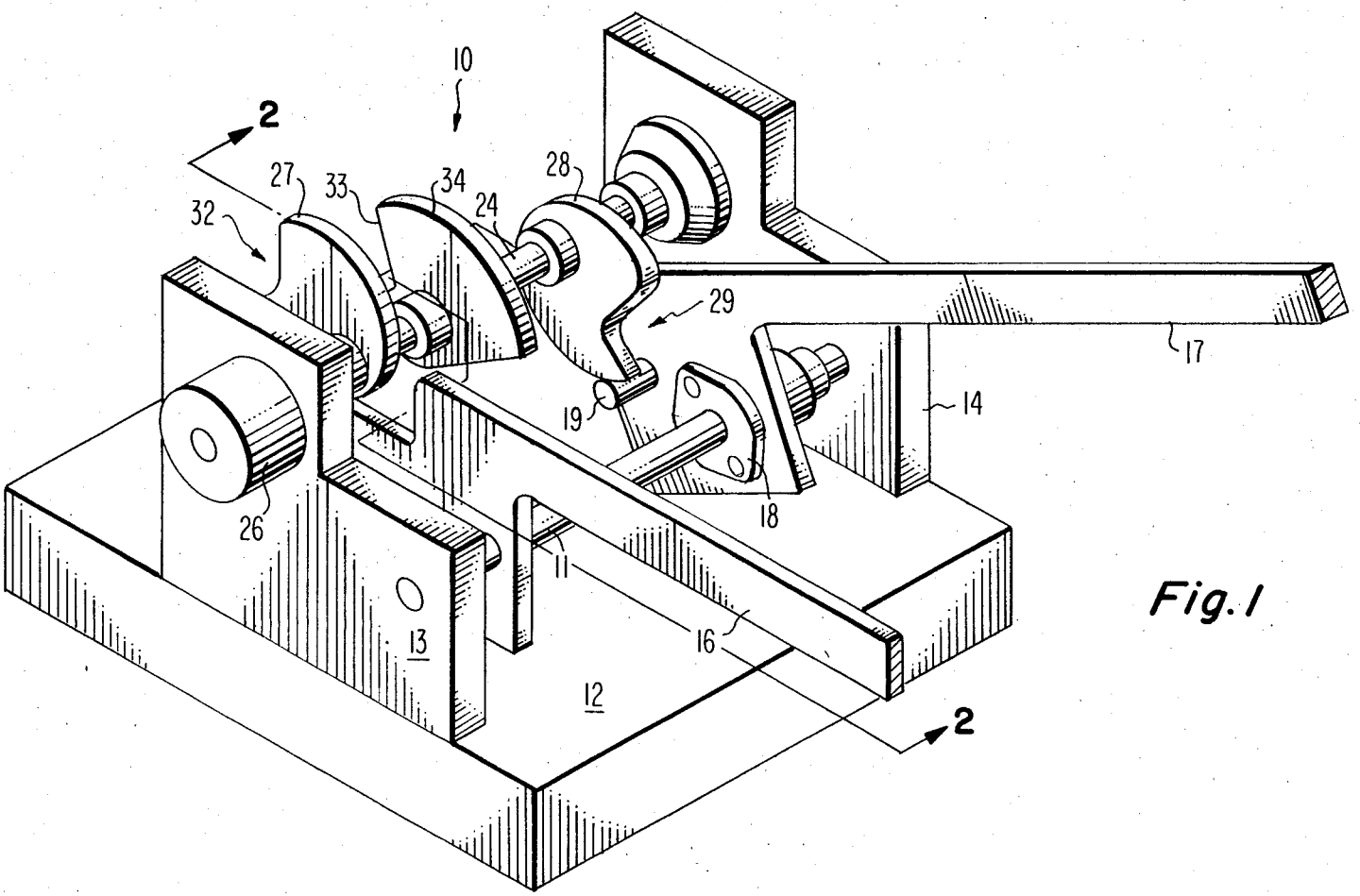
FIG. 1 is an isometric, partially broken away, of a preferred embodiment of a cam and thumper arm arrangement.
Figure 2:
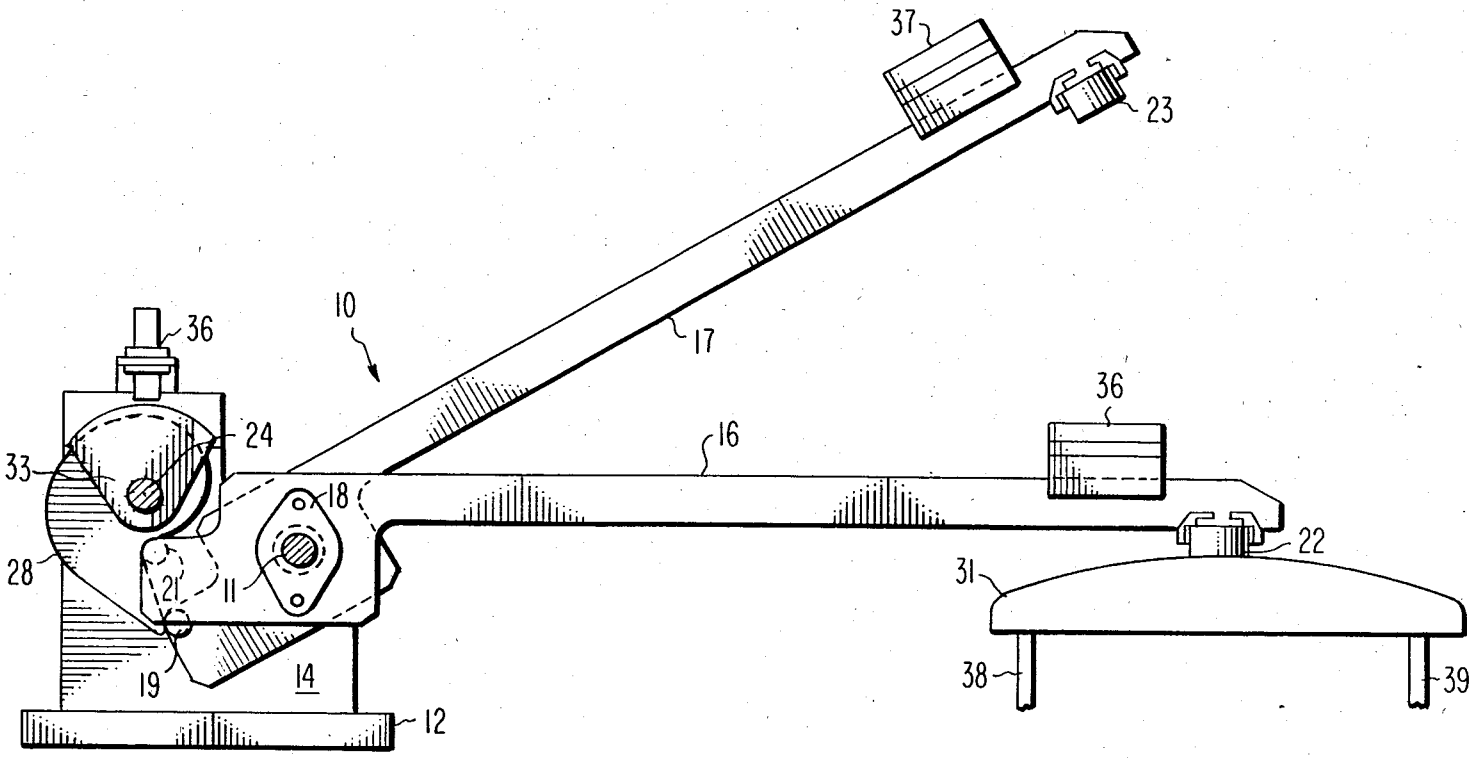
FIG. 2 is a side view, along line 2—2 of FIG. 1.

In FIGS. 1 and 2, the thumper apparatus 10 includes a fixed shaft 11, supported above a base 12 by two side supports 13 and 14. Thumper arms 16 and 17 are arranged to freely pivot on the fixed shaft 11 by bearings 18. A cam follower 19 is fixed to one end of the thumper arm 17. In FIG. 2, a similar cam follower 21 is affixed to one end of the thumper arm 16. Thumpers 22 and 23 are affixed to the distal ends of the arms 16 and 17, respectively.

A rotatable shaft 24 is arranged parallel to the fixed shaft 11, and is rotatably supported by the side supports 13 and 14. The rotatable shaft 24 is rotated by a motor 26. Cams 27 and 28 are fixed to the rotatable shaft 24 and rotate along with the shaft. The edges of the cams form follower surfaces which engage the cam followers 19 and 21. Accordingly, the edge of the cam 28 acts against the cam follower 19 to cause the thumper 23 on the thumper arm 17 to rotatate upwardly away from the plane of the base 12. The cam 28 includes an inset portion 29 to enable the edge of the cam to disengage the cam follower 19 and cause the arm 17 to pivot downwardly and the thumper 23 impacts a faceplate 31, which is located in the proximity of the thumpers 22 and 23. The cam 27 includes a similar inset portion 32 to disengage the arm 16 from the cam follower 21. The inset portions 29 and 32 and the cams 27 and 28 face in opposite directions so that the arms 16 and 17 are alternately disengaged from the cams to alternately impact the panel 31.

A sensor element 33 is affixed to the rotatable shaft 24 to rotate with the shaft. The sensor element 33 includes a sensor surface 34 which, as shown in FIG. 2, comes within the close proximity of a sensor 36. The motor 26 includes a timer whereby upon actuation the motor runs for a preselected time. When the preselected time expires the motor 26 continues to run until the sensing surface 34 comes into the proximity of the sensor 36 and the motor 26 is turned off. This assures that both the arms 16 and 17 are in the raised position when the apparatus is turned off. In the preferred embodiment, the motor 26 runs at a speed of 26 RPM for 15 seconds. Accordingly, each of the thumpers 22 and 23 impacts the panel 31 six times.

Figure 3:
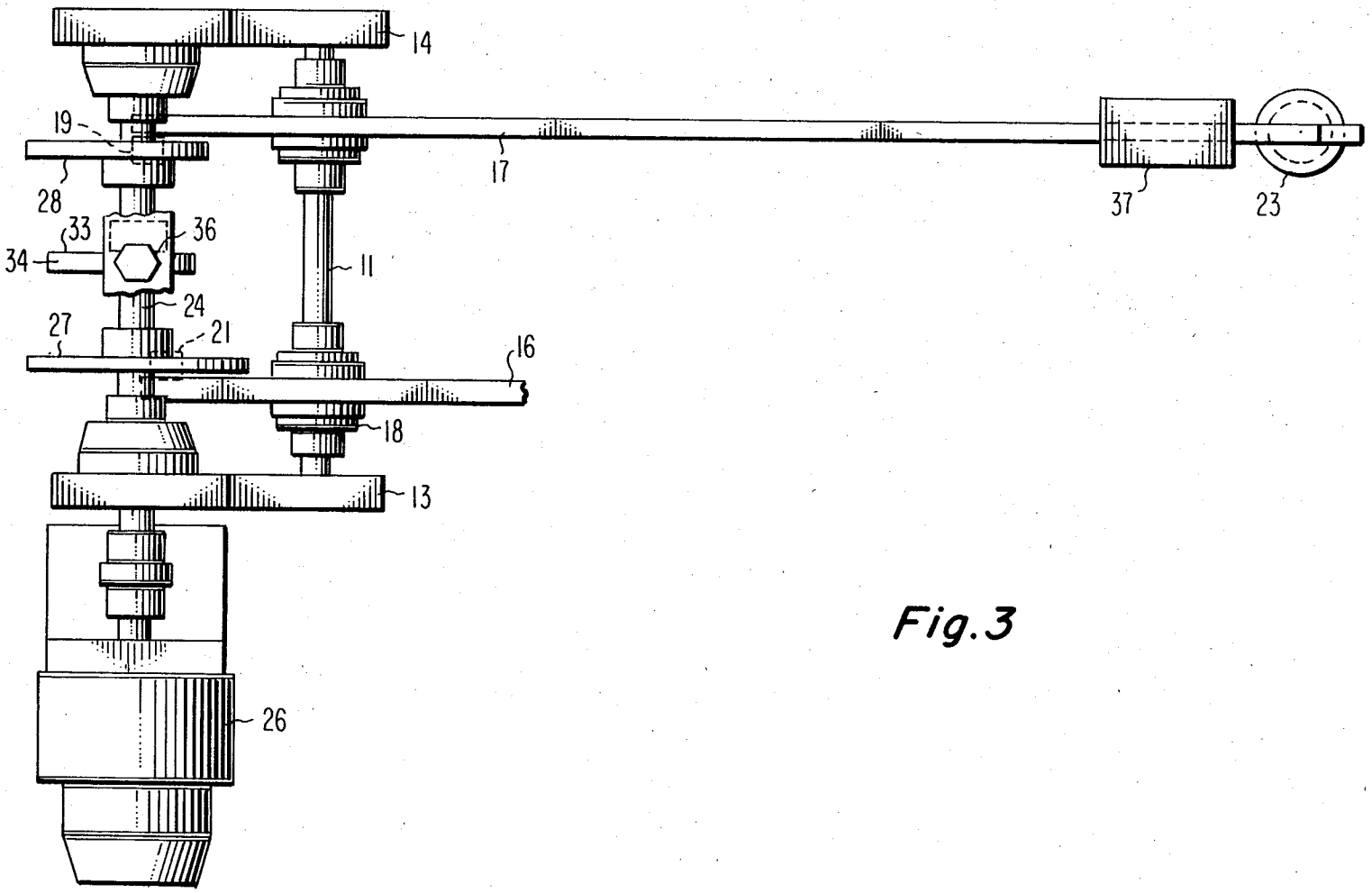
FIG. 3 is a top view, partially broken away, of the preferred embodiment of FIG. 1.

In FIGS. 2 and 3, when the cam followers 19 and 21 disengage the cams 28 and 27 respectively, the arms 16 and 17 rotate downwardly and the thumpers 22 and 23 impact the kinescope faceplate panel 31. Because the portions 32 and 29 and the cams 27 and 28 face in opposite directions, the cams alternate thumping against the faceplate panel 31. The arms 16 and 17 support weights 36 and 37, respectively, in the proximity of the thumpers 22 and 23. The weights 36 and 37 are adjustable along the arms and thus can be used to adjust the impact with which the thumpers 22 and 23 impact the panel 31. The panel 31 is supported in the proximity of the thumpers by vertical supports 38 and 39, shown in more detail in FIG. 4.

In FIG. 3, the cam 27 is larger on one side than the cam 28 and extends for substantially equal distances on both sides of the center of the shaft 24. The enlarged portion of the cam 27 is located so that both of the arms 16 and 17 are in the raised position when the sensing surface 34 of the sensor element 33 is beneath the sensor 36. This is advantageous in moving panels onto and off of the vertical supports 38 and 39.

Figure 4:
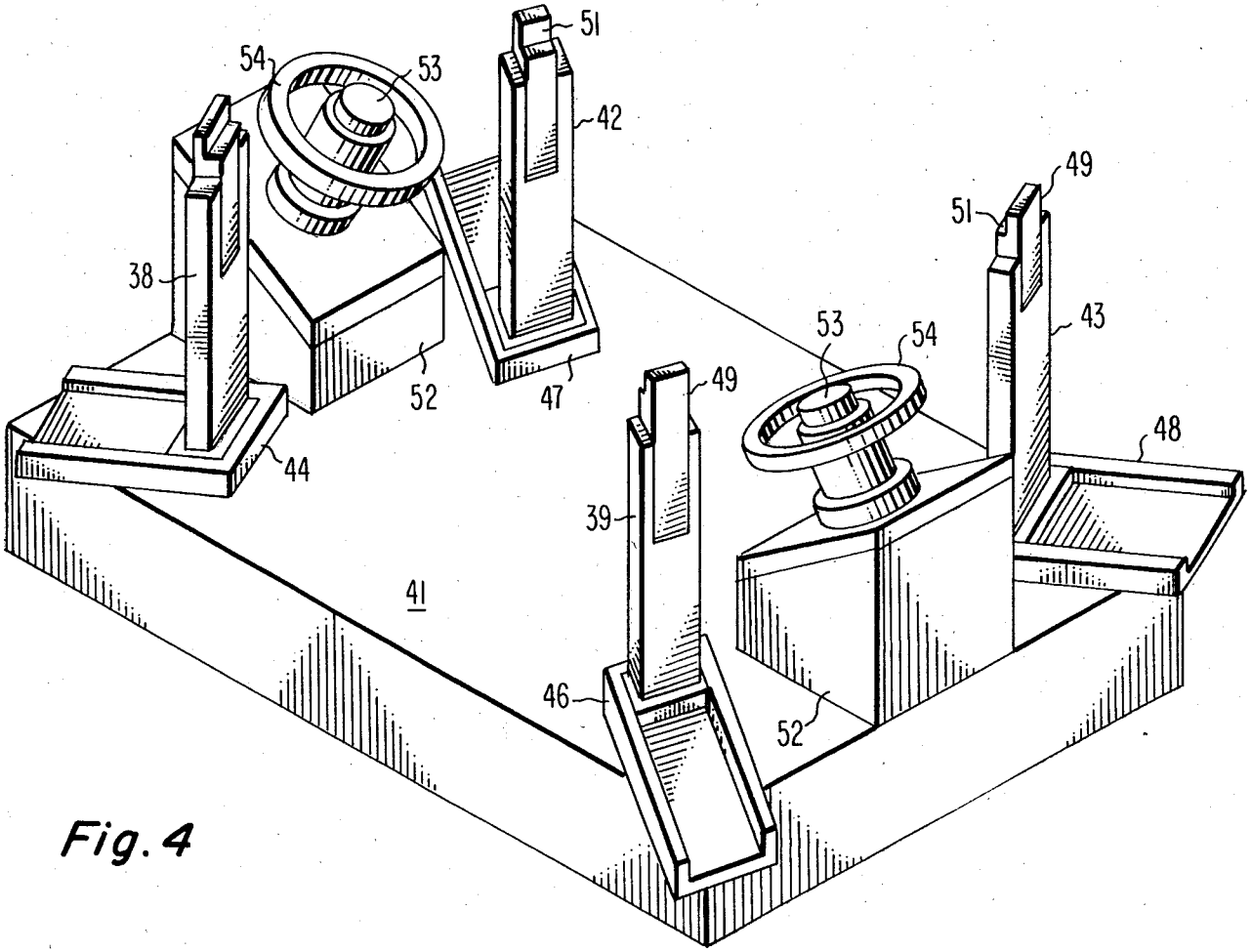
FIG. 4 is an isometric view of a preferred embodiment of a charged air flush apparatus.

In FIG. 4, the vertical supports 38 and 39 are arranged perpendicular to a base member 41. Additional similar vertical supports 42 and 43 also are arranged perpendicular to the base 41. The vertical supports 38, 39, 42 and 43 are supported by horizontal channels 44, 46, 47, and 48 respectively. The horizontal channels are arranged with their center lines substantially parallel to the diagonals of the rectangular base 41. Accordingly, the vertical supports 38, 39, 42, and 43 are slidable within the channels and, the spacing of the vertical supports is readily adjustable so that different size kinescope panels can be placed onto the supports. Each of the vertical supports includes a resilient member 49, which are made of a hard non-deformable material, such as nylon, to receive the corners of the faceplate panel without marring or damaging the panel during the thumping process. Each of the supports 49 includes a recess 51 for supporting the faceplate panels above the base 41. During the thumping the panels are prevented from sliding because the parallel relationship of the channels 44, 46, 47 and 48 and the diagonals of the base 41 causes the resilient members 49 to engage the corners of the panel and prevent the panels from moving in either horizontal direction. Also, if desired, a clamping arrangement can be used to firmly hold the panels in the recesses 51.

Air amplifiers 52 are arranged at opposite ends of the base 41. These are standard commercially items and cause a substantial amount of air to be exited from the exit orifices 53 of the amplifiers. For example, Model No. 915 available from Vortec Corporation can be used as the air amplifiers. Arranged around the air exit orifices 53 are circular ionizers 54. The ionizers 54 are energized with a high voltage alternating current to create a corona, or electric field, which causes the air which passes thrugh the corona to be charged, frequently called ionized air. The charged air sweeps across the panel/mask frame assembly so that both the assembly and any particles clinging to assembly, because of static charge, are similarly charged. The similar charges cause any particles to be repelled from the assembly and removed from the vicinity of the assembly. The combination of the charged air flowing across the assembly, and the thumping by the thumpers 22 and 23 causes a substantial number of small particles, which otherwise could result in blocked apertures or shorted electron guns, to be disengaged from the assembly prior to the assembly being mated with a funnel to complete the assembly of a kinescope.

What is claimed is:

1. A device for dislodging potentially aperture blocking particles from a kinescope panel/mask frame assembly comprising:

a fixed shaft;

at least one thumper arm pivotably supported by said fixed shaft, one end of said arm having a cam follower, and the other end of said arm having a faceplate thumper;

a rotatable shaft arranged substantially parallel to said fixed shaft;

at least one cam fixed to said rotatable shaft for rotation with said shaft, said cam having a curved surface for engaging said cam follower and raising said faceplate thumper above a faceplate panel located in the proximity of said thumper, and said cam having an inset portion for disengaging said cam follower whereby said arm pivots downwardly and said thumper impacts said faceplate panel;

means for rotating said rotatable shaft;

means for supporting a faceplate panel in the proximity of said thumpers; and means for blowing charged fluid across said panel/mask frame assembly while said thumper impacts said panel.

2. The device of claim 1 wherein there are at least two of said arms and two of said cams.

3. The device of claim 2 wherein said cams and said inset portions face in opposite directions whereby said arms are alternately raised and lowered.

4. The device of claim 3 further including means on each of said arms for adjusting the impact force of said thumpers.

5. The device of claim 4 further including a sensor element having a sensing surface affixed to said rotatable shaft, and sensor means supported in the proximity of said sensor element, whereby said sensor means senses said sensing surface to stop said rotatable shaft at a desired orientation.

6. The device of claim 5 wherein said means for blowing charged air includes at least one air amplifier including ionizing means for charging air exiting from said air amplifier.

7. The device of claim 5 wherein one of said cams is larger than the other of said cams whereby both of said arms are in a raised position when said device is loaded and unloaded.

8. The device of claim 3 wherein said means for blowing charged air includes at least one air amplifier including ionizing means for charging air exiting from said air amplifier.

9. The device of claim 3 wherein one of said cams is larger than the other of said cams whereby both of said arms are in a raised position when said device is loaded and unloaded.

10. The device of claim 2 wherein one of said cams is larger than the other of said cams whereby both of said arms are in a raised position when said device is loaded and unloaded.

11. A method of dislodging potentially aperture blocking particles from the panel/mask frame assembly of a kinescope comprising the steps of:

thumping the top of the panel at a preselected rate; and simultaneously passing charged fluid across said panel/mask frame assembly.

* * * * *